US007490497B2

(12) United States Patent
Adcock

(10) Patent No.: US 7,490,497 B2
(45) Date of Patent: Feb. 17, 2009

(54) LOCK HEATING ASSEMBLY FOR USE IN A PADLOCK DEVICE

(76) Inventor: Allen Adcock, 266 Cypress Point Rd., Petersburg, IL (US) 62675

( * ) Notice: Subject to any disclaimer, the term of this patent is extended or adjusted under 35 U.S.C. 154(b) by 0 days.

(21) Appl. No.: 11/541,149

(22) Filed: Sep. 29, 2006

(65) Prior Publication Data

US 2008/0078213 A1 Apr. 3, 2008

(51) Int. Cl.
*E05B 67/24* (2006.01)
*E05B 67/00* (2006.01)

(52) U.S. Cl. ..... 70/38 A; 70/51; 70/52

(58) Field of Classification Search ..... 70/51, 70/54–55, 38 A, 52, DIG. 10, DIG. 49, 435, 70/437; 292/DIG. 66
See application file for complete search history.

(56) References Cited

U.S. PATENT DOCUMENTS

| | | | | | |
|---|---|---|---|---|---|
| 2,232,577 | A * | 2/1941 | West, Jr. | 70/216 |
| 2,530,513 | A * | 11/1950 | Drugan | 219/201 |
| 2,538,872 | A * | 1/1951 | Jones | 70/431 |
| 3,475,930 | A * | 11/1969 | Foote | 70/38 R |
| 3,662,149 | A * | 5/1972 | Lipinski | 219/201 |
| 3,858,419 | A * | 1/1975 | Hampton | 70/55 |
| 4,098,100 | A * | 7/1978 | Wah | 70/38 A |
| 4,304,548 | A | 12/1981 | Ruhaut et al. | |
| 4,442,341 | A * | 4/1984 | Lesquereux et al. | 219/201 |
| 4,732,562 | A | 3/1988 | Palsson | |
| 4,927,993 | A * | 5/1990 | Simmons | 219/201 |
| 5,153,410 | A * | 10/1992 | Barnes | 219/201 |
| 5,573,685 | A * | 11/1996 | Boncaldo | 219/201 |
| 5,704,231 | A * | 1/1998 | Heald | 70/54 |
| 5,727,405 | A * | 3/1998 | Cromwell | 70/38 B |
| 5,791,179 | A * | 8/1998 | Brask | 70/278.1 |
| 5,868,013 | A * | 2/1999 | Julien | 70/38 A |
| 6,192,721 | B1 | 2/2001 | Monteleone | |
| 6,334,346 | B1 * | 1/2002 | Wang | 70/214 |
| 6,442,983 | B1 * | 9/2002 | Thomas et al. | 70/38 A |
| 6,467,316 | B1 | 10/2002 | Chen | |
| 6,813,914 | B2 * | 11/2004 | Chen | 70/50 |
| 6,860,127 | B2 | 3/2005 | Chen | |
| 2004/0102702 | A1 * | 5/2004 | Shimazaki | 600/437 |
| 2005/0252260 | A1 * | 11/2005 | Chu | 70/262 |
| 2006/0213243 | A1 * | 9/2006 | Bosin | 70/432 |

FOREIGN PATENT DOCUMENTS

WO WO 9947772 A1 * 9/1999

* cited by examiner

*Primary Examiner*—Patricia L Engle
*Assistant Examiner*—Alyson M Merlino
(74) *Attorney, Agent, or Firm*—Law Office of Robert M. Patino

(57) ABSTRACT

A lock heating assembly for use with a padlock device to add heat internally within the padlock device that acts to thaw frozen elements in or around the padlock device by triggering an activation mechanism which induces a power supply to supply the electrical current to an at least one heating element that resides in an electrical relationship with the power supply and the activation mechanism, where the at least one heating element resides in heat radiational proximity to the lock housing of the padlock device.

15 Claims, 4 Drawing Sheets

LOCK HEATING ASSEMBLY FOR USE IN A PADLOCK DEVICE

BACKGROUND OF THE INVENTION

1. Field of the Invention

The invention relates to transportable locks, and more specifically the invention relates to padlocks where the lock mechanism of the padlock may freeze and prevent unlocking and opening the lock when used in cold and humid environments.

2. Background of the Invention

Conventional locks, including padlocks, are in widespread use for securing articles and doors. Padlocks often comprise a moveable U-shaped hasp or shackle that emanates from and inserts into the lock body and engages a lock assembly within the lock body to secure the shackle in a closed position. The lock assembly is most often a keyed lock or a combination lock. Often these locks are used outdoors or are exposed to conditions such as high-moisture-content air and freezing temperatures. For example, in the self-storage facilities industry many outdoor-accessible storage lockers are secured with renter-owned padlocks. In these situations, padlocks exposed to adverse weather are often used without any protective means employed to prevent freezing. Freezing weather frequently leads to a problem where a key will not turn a frozen lock mechanism in the padlock, leading to the result of the frozen locks being cut off and destroyed because they cannot be opened while frozen.

Several methods are known in prior art for preventing the freezing of the lock by protecting it from the contamination of moisture and other elements. Other methods exist that are employed for thawing the lock to enable the lock to be opened.

One general approach to the problem of the frozen lock is to protect the lock from the elements, and there are a variety of protective means disclosed in prior art. One method is to completely encase the padlock in a protective material, such as flexible plastic, rubber, or a rigid material such as metal. One example is U.S. Pat. No. 6,467,316, which discloses a rigid protective sleeve around a padlock. Another example is U.S. Pat. No. 6,192,721, which discloses a flexible pouch in which the padlock is encased. There are also several disclosures of seals which fit over the keyhole or around the shackle holes, such as in U.S. Pat. No. 6,813,914. All of these approaches may help prevent a frozen lock by keeping moisture out of the lock, but they do not help free a lock which becomes frozen in spite of the protective means. Further, most of these devices require they be separately acquired and applied to a lock. Lock users who do not take these precautionary measures find the unprotected lock may become frozen and therefore, must be destroyed if prompt opening is required.

Another approach to the frozen lock problem is to design the lock itself by having a protective means incorporated in the design and manufacture of the lock device. One example is in U.S. Pat. No. 6,860,127, which discloses a weather-resistant lock apparatus. Locks designed to be weather-resistant may help prevent a frozen lock, but suffer the same problem as lock protectors in that the features do not help free a lock which becomes frozen in spite of the protective design. Users often don't anticipate sudden changes in the weather and are left with the same problem that conventional pad locks suffer from in freezing conditions.

Still yet another approach to the frozen lock problem is a device for thawing the frozen lock. One approach in the prior art to thawing locks is to heat an apparatus which is inserted into the key slot to warm the locking mechanism from its key cavity. For example, U.S. Pat. No. 4,732,562 describes a device which heats a metal rod which is then inserted into a keyed lock to thaw the locking mechanism. This invention requires that the separate heating device be available when encountering a frozen lock. This can be burdensome, since often large numbers of locks are present and used infrequently by a large number of people, but only a few of them will be frozen at any time they need to be opened. Having such a device available to a large number of people for infrequent use is difficult to arrange. Another suggested approach is to heat the key that is used in each individual lock. U.S. Pat. No. 4,304,548 describes a modified cigarette lighter which heats an attached key before inserting the key in its lock, so that the key can heat the inside of the lock mechanism that is frozen. This invention also requires that the device be available when encountering a frozen lock, and also can pose a safety hazard if the key is overheated.

Other approaches exist for thawing frozen locks, such as using anti-freeze sprays or splashing warm water on the frozen lock. These techniques require the availability and use of separate components which may not be available to a lock user when encountering a frozen lock, as may be the case with other techniques. The addition of fluids to a frozen lock may even provide an increased capacity to freeze by introducing moisture to an already-frozen lock. Both of these traits make these approaches undesirable or ineffective for the problem.

Further, there are suggestions to use warm hands or blow warm breath onto the lock. A very cold lock touching bare skin, however, may freeze the skin on the hands of the person trying to thaw the lock. And breathing or blowing hot air on a frozen lock requires a long time and great amount of effort if the lock is very cold, making it a difficult and time-consuming approach. Breathing may also introduce moisture to the lock that may make the lock's capacity to freeze increase, rather than make the lock thaw.

As noted, the previous approaches to the frozen lock suffer several shortcomings. First, the use of an external protective means on a lock device may keep some moisture and contamination out, but cannot prevent freezing, and these approaches are not helpful once a lock is already frozen. Second, prior art methods for thawing the lock either require special equipment that can be misplaced or may not be available when needed, or may not be applicable to padlocks such as those used in cold temperature environments. Third, specially-designed weather-resistant locks are complex and tend to be expensive to manufacture.

Thus, based on the prior art and known designs, there is a need for a padlock device which does not require external protective parts that can be lost or misplaced. There is also a need to have a means of warming an internal region within a padlock device sufficiently such that frozen moveable parts in and around a lock housing may become thawed for normal operational use. Furthermore, there is a need for such a padlock device that is capable of being manufactured and maintained inexpensively and capable of effectively providing power needed for such a proposed warming function.

SUMMARY OF THE INVENTION

The above-identified needs are addressed by the present lock heating assembly for use with a padlock device to add heat to a lock housing. One feature of the present invention is an at least one heating element that preferably resides on the interior of an assembly housing that delivers heat to thaw frozen moveable parts located in or around the lock housing. This feature eliminates the needs for bringing an external warming device or attachment. Another feature of the present invention is an activation mechanism located on the padlock device that can be triggered easily by an operator to activate a power supply source. By triggering the activation mechanism when it is discovered that the lock is frozen, the at least one heating element is acted on by a flow of electrical current that generates the heat. The activation mechanism provides a safe and easy to use method of delivering the operational power needed that can by used by children and adults alike.

The at least one heating element is preferably located in heat radiational proximity to the moveable parts of the lock housing to melt any ice that may have built up to allow the lock device to become operational. Therefore, users of the present lock heating assembly do not have to worry about using a prevention method of keeping moisture out of the lock housing. The obvious advantage is that the padlock device can be made openable when locked while used in freezing conditions, such as when the air temperature is below the freezing point, without the use of additional external protective devices. Furthermore, by using a small battery cell as the power source, the present lock heating assembly becomes easy and inexpensive to maintain. Since the present invention uses a conventional means of construction for the assembly housing, the manufacture of the padlock device would be simple with only a minimal, if any, additional cost.

More specifically, a lock heating assembly is provided for use with a padlock device to add heat to a lock housing that includes an activation mechanism and a power supply associated with the activation mechanism for providing power when the activation mechanism is triggered. An at least one heating element resides in an electrical relationship with the power supply and the activation mechanism so that when an electrical current is applied to the at least one heating element, heat is generated. The at least one heating element preferably resides in heat radiational proximity to the lock housing of the padlock device such that when the activation mechanism is triggered, the at least one heating element is acted upon to induce heat on the lock housing.

In another embodiment, a lock heating assembly for use with a padlock device to add heat to a lock housing is provided that includes an assembly housing and a hasp that is moveable from a secured position within the assembly housing to a released position. A means of providing an electrical current from a power supply is preferably located on or within the assembly housing. An at least one heating element resides in heat radiational proximity to the lock housing of the padlock device such that when the at least one heating element is acted upon by the electrical current, heat is induced onto the lock housing.

In yet another embodiment, a lock heating assembly for use with a padlock device to add heat to a lock housing is provided that further includes a low power indicator light for indicating when a power supply is running low. The low power indicator light is located on an outside perimeter of a housing assembly. A hasp is also included that is moveable from a secured position within the assembly housing to a released position. An activation mechanism is also provided and is located on the outside perimeter of the assembly housing. The power supply is associated with the activation mechanism to provide power when the activation mechanism is triggered. An at least one heating element resides in an electrical relationship with the power supply and the activation mechanism. Furthermore, the at least one heating element resides in heat radiational proximity to the lock housing of the padlock device such that when the activation mechanism is triggered, the at least one heating element is acted upon to induce heat on the lock housing.

BRIEF DESCRIPTION OF THE DRAWINGS

The preferred embodiment of the invention will be described in reference to the accompanying drawings in which.

DETAILED DESCRIPTION OF THE PREFERRED EMBODIMENT

Figure 1:
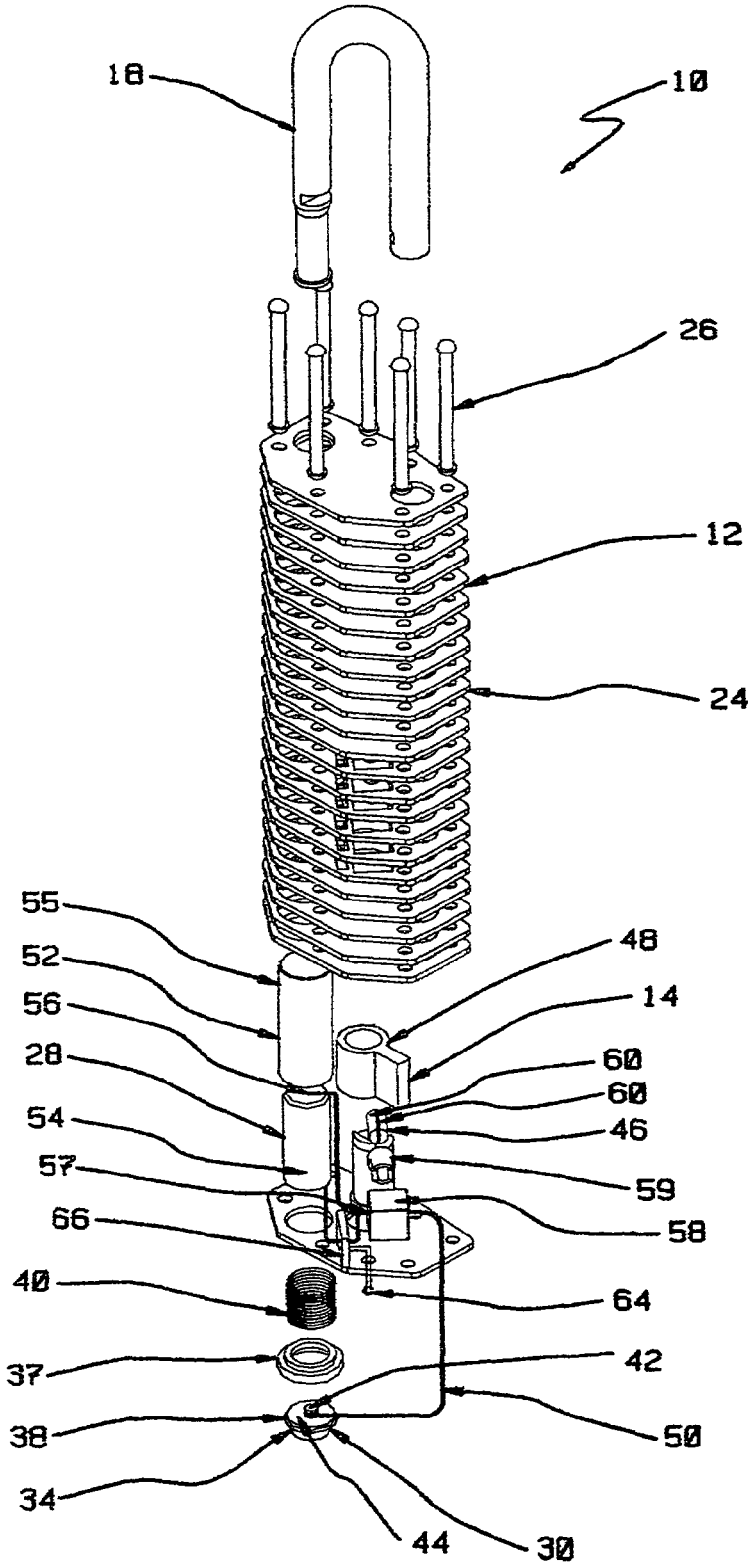
FIG. 1 is a disassembled front view perspective of a padlock device containing a lock heating assembly of the present invention.
Figure 2:
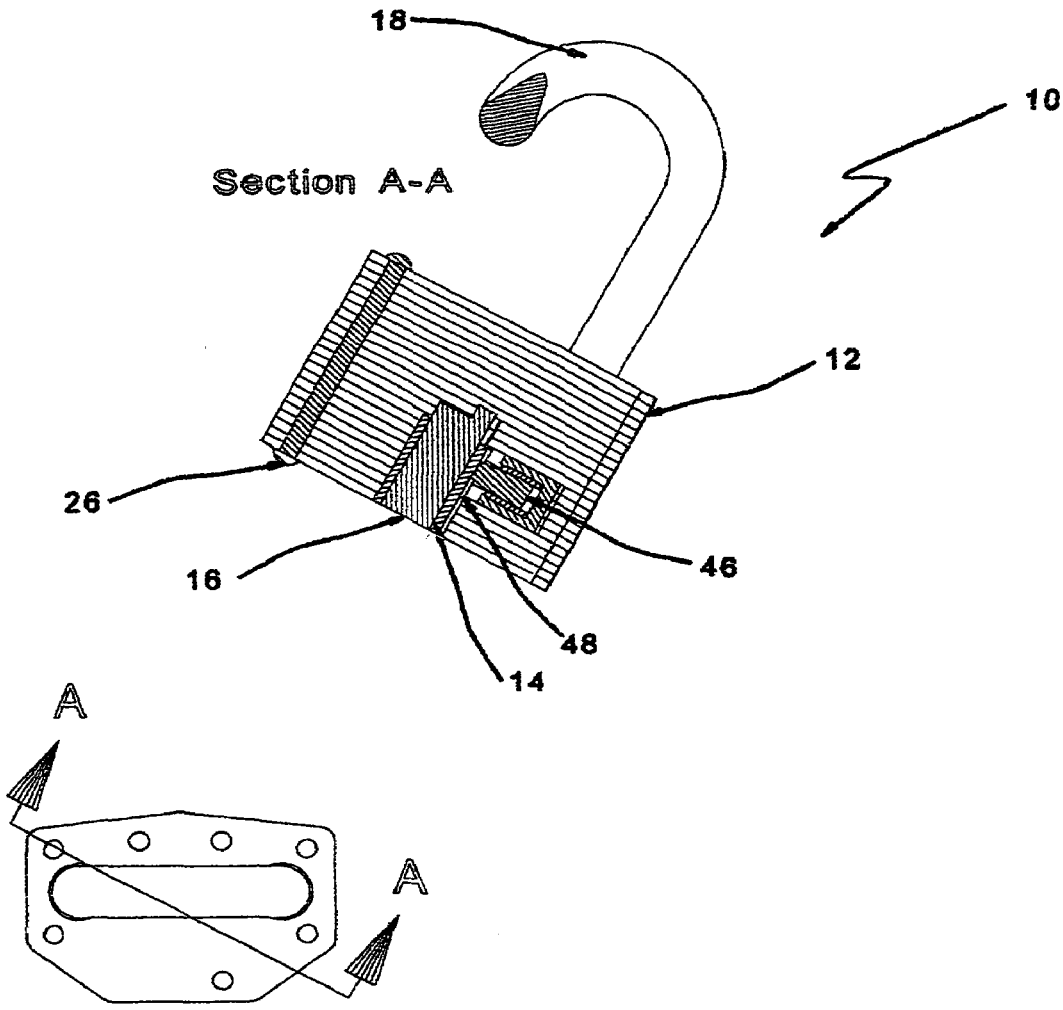
FIG. 2 is a cross-sectional angled side view of the padlock device illustrating how a lock housing or an electrically conductive heat conduction element interacts with a heating element and a heating element housing.

Referring now to FIG. 1 and 2, a lock heating assembly for use with a padlock device is generally designated 10. An assembly housing 12 houses a lock housing 14, which in turn, houses a tumbler housing 16. Moveable parts within and around the lock housing 14 and the tumbler housing 16 are susceptible to freezing when moisture enters the assembly housing 12, rendering the padlock device inoperable under frozen conditions. The tumbler housing 16 is pivotable when tumblers are acted upon by a releasing key to align internal pins to a shear line. When the tumblers become fixed and immovable by frozen moisture or liquids, proper alignment becomes impossible to attain.

Figure 3:
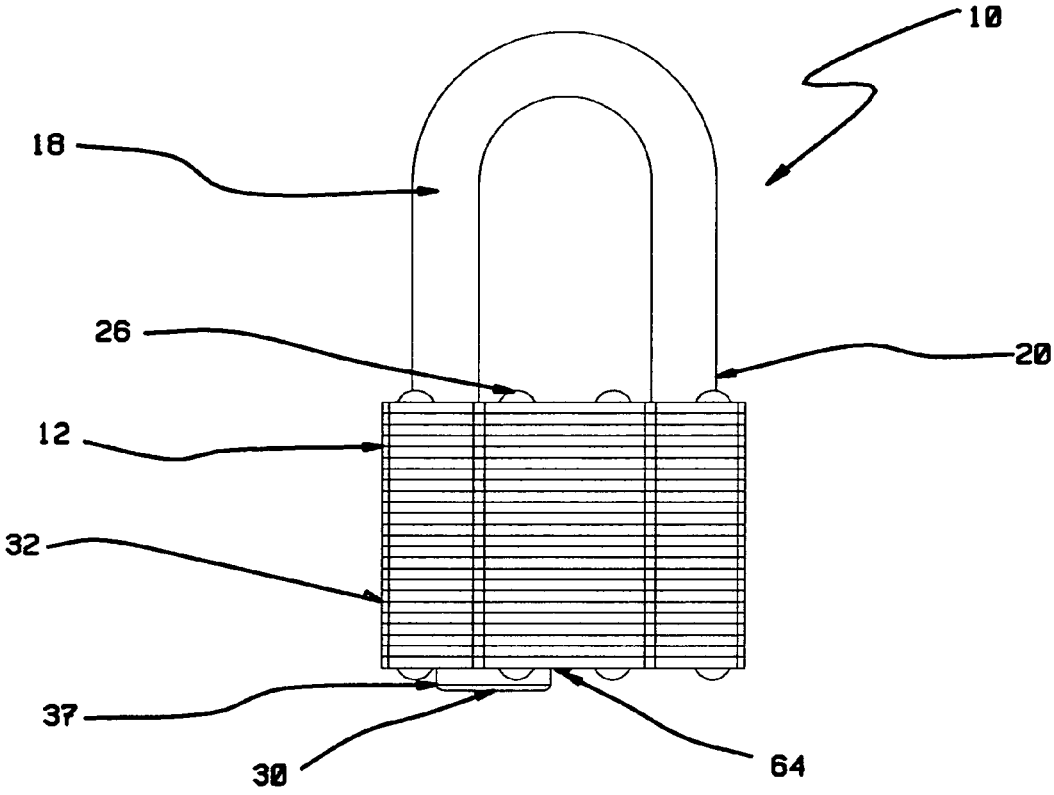
FIG. 3 is a front view of a padlock device containing the lock heating assembly.

Now referring to FIGS. 1 and 3, the assembly housing 12 is designed to receive a hasp 18 and house the hasp 18 in a secured position 20. In the preferred embodiment, the tumbler housing 16 releases the hasp 18 from its secured position 20 (as shown in FIG. 3) when a releasing key (not shown) is inserted into the tumbler housing 16 and rotated. The hasp 18, when released, is moveable from the secured position 20 within the assembly housing 12 to a released position (not shown). The released position enables the padlock device to become releasable from a fixture or other lockable matter because the hasp 18 becomes rotatable on the assembly housing 12.

The assembly housing 12 is preferably made up of a resilient material capable of withstanding a great deal of pressure and stress to enable the padlock device to act as an effective theft deterrent tool. In the most preferred embodiment, a plurality of assembly plates 24 are placed horizontally and stacked in a vertical manner relative to the tumbler housing 16. The plurality of assembly plates 24 are constructed of a durable metal material such as stainless steel and have etched or punched receiving gaps to accommodate internal features such as the lock housing 14, the hasp 18, and other like additions. To place the plurality of assembly plates 24 into a continuous, inseparable pairing as shown in FIG. 3, the plurality of assembly plates 24 are fastened together by a plurality of rivets 26 used to seal the plurality of assembly plates 24 together so that the assembly housing 12 appears as one continuous housing unit.

Figure 4:
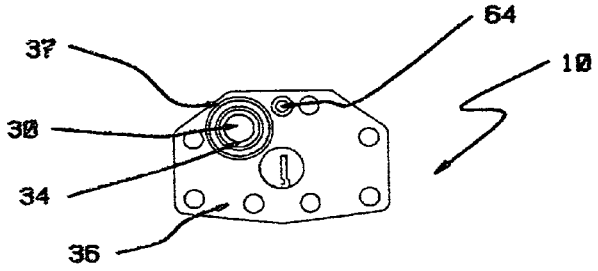
FIG. 4 is bottom view of the padlock device containing the lock heating assembly.

Now referring to FIGS. 1, 3 and 4, the lock heating assembly 10 is designed to add heat to the lock housing 14 by triggering a means of providing an electrical current from a power supply 28 located on or within the assembly housing 12. In the preferred embodiment, the means of providing the electrical current from the power supply 28 is provided by an activation mechanism 30. The power supply 28, therefore, is associated with the activation mechanism 30 for providing power when the activation mechanism 30 is triggered.

The activation mechanism 30 preferably located on an outside perimeter 32 of the assembly housing 12 for easy access and operational use. In the most preferred embodiment, the activation mechanism 30 is a pressable button 34 located on an external bottom surface 36 of the padlock device; however, it is further contemplated that a switch or other acting activation mechanism 30 capable of an "on/off" action may be used as well. By placing the pressable button 34 on the external bottom surface 36, the plurality of assembly plates 24 are more easily manipulated to receive the pressable button 34 and the affiliated components that are associated with the pressable button 34. The pressable button 34 is weatherably protected by a pressable button bezel 37 and is may also be provided with an elastic material 38 such as a rubber or plastic material to help prevent moisture from entering the assembly housing 12.

In the preferred embodiment, the pressable button 34 is resideable in a disengaged position when not triggered or acted on. The disengaged position is the default position created by suspending the activation mechanism on a spring 40 so that power is not inadvertently drained from the power supply 28. The pressable button 34 has a conductive pin 42 on a back side 44 of the pressable button 34 to make contact with the power supply 28. The activation mechanism 30 is triggered when the pressable button 34 is pushed inward to a position where the conductive pin 42 completes a closed electrical circuit defined by the power supply 28, an at least one heating element 46, an electrically conductive heat conduction element 48, the conductive pin 42, and all interconnecting wiring 50.

The power supply 28 is preferably located within the assembly housing 12 and space is made for the power supply 28 in a similar manner as the activation mechanism 30 by punching or machining a hole in a series of the plurality of assembly plates 24 to accommodate the power supply 28. In the preferred embodiment, the power supply 28 is a transportable power source 52 usable within multiple padlock devices. In the most preferred embodiment, the transportable power source 52 comprises a battery cell 54 configured to produce sufficient current such that when the at least one heating element 46 is acted upon, heat is generated. The battery cell 54 is resideable entirely within the assembly housing 12 and is placed in a battery cover 55. The battery cell 54 contemplated in the most preferred embodiment is a standard 1.5 Volt battery that can be bought at most conventional stores and provide a cheap and affordable means of providing power to several padlock devices using the lock heating assembly 10.

It is also contemplated that the power supply 28 might also use a solar battery cell, a liquid or gas fuel cell, or other type of electricity producing device. However, these devices are generally expensive and burdensome to use which make them less practical than the more readily available standard batteries. The battery cell 54 is encased in the battery cover 55 to protect the battery cell 54 from becoming corroded by external elements and insulates the battery cell 54 from coming into contact with electrically conductive parts of the plurality of assembly plates 24. The battery cell 54 can easily be removed by unscrewing the pressable button bezel 37 and removing the spring 40 along with the pressable button 34. The battery cell 54 is free to be removed from the battery cover 55 and replaced when needed.

Now referring to FIGS. 1, 2 and 3, in the preferred embodiment, a power supply outlet wire 56 feeds an electrical current to a receiving end 57 of a heating element contact housing 58 that houses a heating element housing 59 and the at least one heating element 46 when the activation mechanism 30 is triggered. The heating element contact housing 58 provides a simple assembly tool to place the heating element housing 59 and the at least one heating element 46 in an electrical relationship with the power supply 28 and the activation mechanism 30. By doing so, when the activation mechanism 30 is triggered, an electrical current to the receiving end 57 begins to flow. In the most preferred embodiment, only one heating element 46 is used. The at least one heating element 46 resides in heat radiational proximity to the lock housing 14 of the padlock device such that when the electrical current is received by the receiving end 57 of the heating element contact housing 58 to feed electricity to the at least one heating element 46, the at least one heating element 46 is acted upon to induce heat on the lock housing 14.

Figure 5:
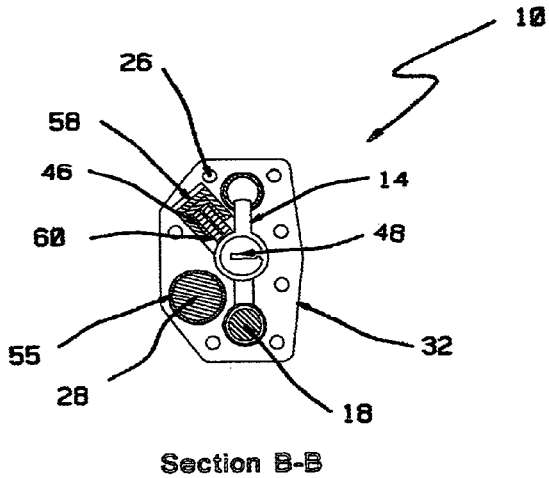
FIG. 5 is a cross-sectional bottom view of the padlock device containing the lock heating assembly illustrating the relationship of a power supply, the lock housing, the hasp, and the heating element.
Figure 5:
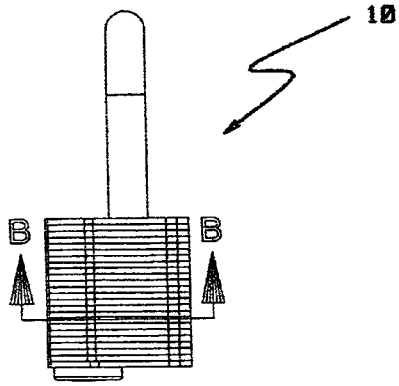

Now referring to FIGS. 1 and 5, in the most preferred embodiment, the at least one heating element 46 is an electrical resister that resists electricity to produce heat and is provided with a set of electrodes 60 that act as electrically conductive proximity contact points. At the contact points with the electrically conductive heat conduction element 48, a large amount of heat is created. The electrically conductive heat conduction element 48 is preferably made of a heat conductive material such as steel, copper, or similar type of metal. The at least one heating element 46 is most preferably a graphite alloy that is better known as Coldheat technology, discussed at length in U.S. Pat. Nos. 6,646,228 and 6,797,924. Using this design, the heating element housing 59 is provided to insulate the at least one heating element 46 from unintentionally contacting other metal found within the lock heating assembly 10. The heat element contact housing 58 is employed to ensure a deliberate delivery of electrical current to the at least one heating element 46 found inside the heating element housing 59.

The set of electrodes 60 is in electrical conductive connection with the electrically conductive heat conduction element 48 that is directly heated to warm the lock housing 14. Heat radiates from the electrically conductive heat conduction element 48 and is induced onto the lock housing 14 to warm the lock housing 14, which in turn transfers heat to the tumbler housing 16. In the most preferred embodiment, the electrically conductive heat conduction element 48 is the lock housing 14 itself, where the at least one heating element directly 48 directly engages the lock housing 14 by the set of electrodes 60. This design enables frozen moisture or liquids to quickly thaw out and melt so that the tumbler housing 16 becomes usable again by the releasing key, as the internal temperatures of the lock housing 14 rapidly and greatly exceed temperatures above the freezing point.

Now referring to FIGS. 1 and 4, as a preferred feature, a low power indicator light 64 for indicating when power in the power supply 28 is running low is located on the outside perimeter 32 of the assembly housing 12. A low battery module 66 is inserted into the interconnecting wiring 50 to register a current to the low power indicator light 64 to activate its illumination. In the most preferred embodiment, the low battery module 66 is in a continuous contact state with the power supply 28 so that the activation mechanism 30 does not have to be triggered in order to see whether or not the power supply 28 still maintains sufficient operational power. When illuminated, the low power indicator light 64 tells the user that a new battery will be needed shortly so that a lock heating assembly 10 is not placed with the false reliance that the lock heating assembly 10 will work properly.

While a particular embodiment of the present lock heating assembly has been described herein, it will be appreciated by those skilled in the art that changes and modifications may be made thereto without departing from the invention in its broader aspects and as set forth in the following claims.

I claim:

1. A lock heating assembly for use with a padlock device, comprising:

a padlock assembly housing that houses an internal lock housing;

an activation mechanism in operational relationship to said padlock assembly housing;

a power supply associated with said activation mechanism for providing power when said activation mechanism is triggered; and at least one heating element that resides in an electrical relationship with said power supply and said activation mechanism, and further, said at least one heating element directly engages said internal lock housing and induces heat upon said internal lock housing when said activation mechanism is triggered.

2. The lock heating assembly of claim 1, wherein said activation mechanism is a pressable button located on an external bottom surface of the padlock device.

3. The lock heating assembly of claim 2, wherein said pressable button is weatherably protected by an elastic material.

4. The lock heating assembly of claim 2, wherein said pressable button is resideable in a disengaged position by a spring when not triggered.

5. The lock heating assembly of claim 1, wherein said power supply is a transportable power source usable within multiple padlock assembly housings.

6. The lock heating assembly of claim 5, wherein said transportable power source comprises a battery cell configured to produce sufficient current such that said at least one heating element is acted upon to generate heat.

7. The lock heating assembly of claim 1, wherein said at least one heating element is provided with a set of electrodes that act as electrically conductive proximity contact points.

8. The lock heating assembly of claim 7, wherein a closed electrical circuit is defined by said activation mechanism, said power supply, said least one heating element, an electrically conductive heat conduction element and interconnecting wiring when said activation mechanism is in an engaged position.

9. The lock heating assembly of claim 7, wherein said internal lock housing is an electrically conductive heat element.

10. The lock heating assembly of claim 1, wherein said padlock assembly housing is constructed of a plurality of assembly plates.

11. The lock heating assembly of claim 10, wherein said plurality of assembly plates are fastened together by a plurality of rivets.

12. The lock heating assembly of claim 1, wherein said activation mechanism is suspended on a spring to reside in a disengaged position.

13. The lock heating assembly of claim 1, wherein the internal lock housing houses a tumbler housing that is pivotable when tumblers are moveable and acted upon by a releasing key.

14. The lock heating assembly of claim 1, wherein said power supply is a battery cell that is resideable entirely within said padlock assembly housing.

15. The lock heating assembly of claim 1, further comprising a low power indicator light for indicating when said power supply is running low located on an outside perimeter of said padlock assembly housing.

* * * * *